US009227757B1

(12) United States Patent
Green et al.

(10) Patent No.: US 9,227,757 B1
(45) Date of Patent: Jan. 5, 2016

(54) SHIELDED PALLET

(71) Applicant: LENOVO ENTERPRISE SOLUTIONS (SINGAPORE) PTE. LTD., New Tech Park (SG)

(72) Inventors: Kenton C. Green, Cary, NC (US); William J. Green, Cary, NC (US); Robert W. Stegner, Raleigh, NC (US)

(73) Assignee: Lenovo Enterprise Solutions (Singapore) PTE. LTD., New Tech Park (SG)

( * ) Notice: Subject to any disclaimer, the term of this patent is extended or adjusted under 35 U.S.C. 154(b) by 0 days.

(21) Appl. No.: 14/444,059

(22) Filed: Jul. 28, 2014

(51) Int. Cl.
*B65D 19/38* (2006.01)
*B65D 19/00* (2006.01)

(52) U.S. Cl.
CPC ..... *B65D 19/38* (2013.01); *B65D 19/0069* (2013.01); *B65D 2519/00094* (2013.01); *B65D 2519/00104* (2013.01); *B65D 2519/00552* (2013.01)

(58) Field of Classification Search
CPC ..... B65D 19/40; F16F 15/08; F16F 7/00
USPC ..... 108/57.12, 51.11, 161; 248/638, 562
See application file for complete search history.

(56) References Cited

U.S. PATENT DOCUMENTS 1,812,861 A * 7/1931 Chase ..... 108/57.12
3,090,331 A * 5/1963 McCann ..... 108/57.12
3,101,063 A * 8/1963 Wharton ..... 108/57.12
3,275,131 A * 9/1966 Erickson ..... 108/57.12
3,426,986 A * 2/1969 Pool ..... 108/57.12
4,292,899 A 10/1981 Steffen
4,715,294 A 12/1987 Depew
5,076,175 A 12/1991 Whatley, II
5,221,176 A 6/1993 Allen et al.
5,588,371 A * 12/1996 Looker ..... 108/57.12
5,673,629 A 10/1997 Ginnow
5,765,800 A * 6/1998 Watanabe et al. ..... 248/638
5,929,395 A * 7/1999 Bizlewicz ..... 248/638
5,970,886 A * 10/1999 Knio ..... 108/57.12
6,209,841 B1 * 4/2001 Houghton et al. ..... 248/638

(Continued)

FOREIGN PATENT DOCUMENTS

DE 202005009034 U1 10/2005
DE 202008014433 U1 8/2009

OTHER PUBLICATIONS

Leinberger, D., "LTL (Less-Than-Truckload) Packaging Tips", ISTA Transpack Conference, Mar. 26, 2013, ABF Freight System, Inc.

*Primary Examiner* — Jose V Chen
(74) *Attorney, Agent, or Firm* — Katherine Brown

(57) ABSTRACT

A pallet comprised of a first deck, a second deck, a dampening device and a shield. The first deck includes an interior surface, an exterior surface and an edge. The second deck includes an interior surface. The dampening device located between the interior surface of the first deck and the interior surface of the second deck. The dampening device configured to contract to counteract a compression force when the first deck and the second deck are pressed together and further configured to deform to counteract an expansive force when the first deck and the second deck are pulled apart. The shield having a first planar member adjacent to the exterior surface of the first deck opposite the dampening device and a second planar member extending from the first planar member to the interior surface of the second deck and adjacent to the edge of the first deck.

18 Claims, 6 Drawing Sheets

(56) References Cited

U.S. PATENT DOCUMENTS

| | | | | |
|---|---|---|---|---|
| 6,418,862 | B1 * | 7/2002 | Heil | 108/57.12 |
| 6,598,545 | B2 * | 7/2003 | Ryaboy et al. | 108/57.12 |
| 6,609,467 | B2 * | 8/2003 | Monson et al. | 108/57.12 |
| 7,637,219 | B2 * | 12/2009 | Hartel et al. | 108/57.12 |
| 7,748,329 | B2 | 7/2010 | Baltz | |
| 7,779,765 | B2 | 8/2010 | Donnell, Jr. et al. | |
| 2002/0112653 | A1 | 8/2002 | Moore, Jr. et al. | |
| 2003/0037710 | A1 * | 2/2003 | Monson et al. | 108/57.12 |
| 2005/0000395 | A1 | 1/2005 | Apps et al. | |
| 2007/0113758 | A1 | 5/2007 | Elkins et al. | |
| 2007/0221102 | A1 * | 9/2007 | Reinhall | 108/57.12 |
| 2007/0234933 | A1 | 10/2007 | Donnell, Jr. et al. | |
| 2007/0283858 | A1 * | 12/2007 | Ballard | 108/57.12 |
| 2013/0032063 | A1 | 2/2013 | Randall et al. | |

* cited by examiner

SHIELDED PALLET

BACKGROUND

The present disclosure relates to pallets, and more specifically, to shields to protect pallet blocks and stringers.

Cushioned pallets (or shock pallets) can be used when shipping fragile products that are susceptible to damage in transit. These pallets are designed with cushioning and/or dampening material integrated in the pallets' blocks and stringers to reduce the shock seen by the products mounted onto the pallets. These pallets can be used to protect large and heavy rack products (1000+ lbs) against shock and/or vibration damage while the product is being shipped. Large rack products can be handled somewhere within the supply chain by a fork lift. This is because the products are so large and heavy, that moving via pallet jack is extremely slow, and depending on the infrastructure, impossible if the rack product needs to change elevation (either go up a hill or sit onto a raised area). Fork lifts are large and generally have to move and turn static products to get them to fit properly within trucks and warehouses to maximize space. In some cases there is not any room, or there is just no time for the fork lift operator to pick a product up and move it via a series of turns. Damage can occur to wooden stringers and blocks and when soft foam blocks are used, the results can be disastrous when a careless or hurried fork lift driver wishes to turn a heavy rack product in transit by using the fork tines to push the blocks. These blocks can be damaged or cut to the point that the pallet integrity is compromised.

SUMMARY

According to embodiments of the present disclosure, a pallet is disclosed. In various embodiments, the pallet may include a first deck having a first interior surface, an exterior surface and an edge. The pallet may also include a second deck having a second interior surface facing the first interior surface of the first deck. In addition, the pallet may include a dampening device between the first interior surface of the first deck and the second interior surface of the second deck. The dampening device may be configured to contract to counteract a compression force when the first deck and the second deck are pressed together and further configured to deform to counteract an expansive force when the first deck and the second deck are pulled apart. Furthermore, the pallet may include a shield. The shield may include a first planar member adjacent to the exterior surface of the first deck opposite the dampening device. The shield may also include a second planar member extending from the first planar member to the second interior surface of the second deck and adjacent to the edge of the first deck.

According to embodiments of the present disclosure, a pallet is disclosed. In various embodiments, the pallet may include a first deck having a first interior surface, a first exterior surface, and first edge. The pallet may also include a second deck having second interior surface, a second exterior surface, and a second edge. In addition, the pallet may include a dampening device between the first interior surface of the first deck and the second interior surface of the second deck. Also, the pallet may include a first shield. The first shield may include a first planar member adjacent to the first exterior surface of the first deck and opposite the dampening device. The first shield may also include a second planar member extending from the first planar member towards the second interior surface of the second deck and adjacent to the first edge of the first deck. Furthermore, the pallet may include a second shield. The second shield may include a third planar member adjacent to the second exterior surface of the second deck and opposite the dampening device. The second shield may also include a fourth planar member extending from the third planar member towards the first interior surface of the first deck to at least the second planar member of the first shield.

According to embodiments of the present disclosure, a pallet is disclosed. In various embodiments, the pallet may include a first deck having a first interior surface. The pallet may also include a second deck having a second interior surface facing the first interior surface. In addition the pallet may include a dampening device between the first deck and the second deck. Also, the pallet may include a first shield. The first shield may include a first planar member between the first interior surface of the first deck and the dampening device. The first shield may also include a second planar member extending from the first planar member towards the second interior surface of the second deck. Furthermore, the pallet may include a second shield. The second shield may include a third planar member between the second interior surface of the second deck and the dampening device. The second shield may also include a fourth planar member extending from the first planar member towards the first interior surface of the first deck to at least the second planar member of the first shield.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
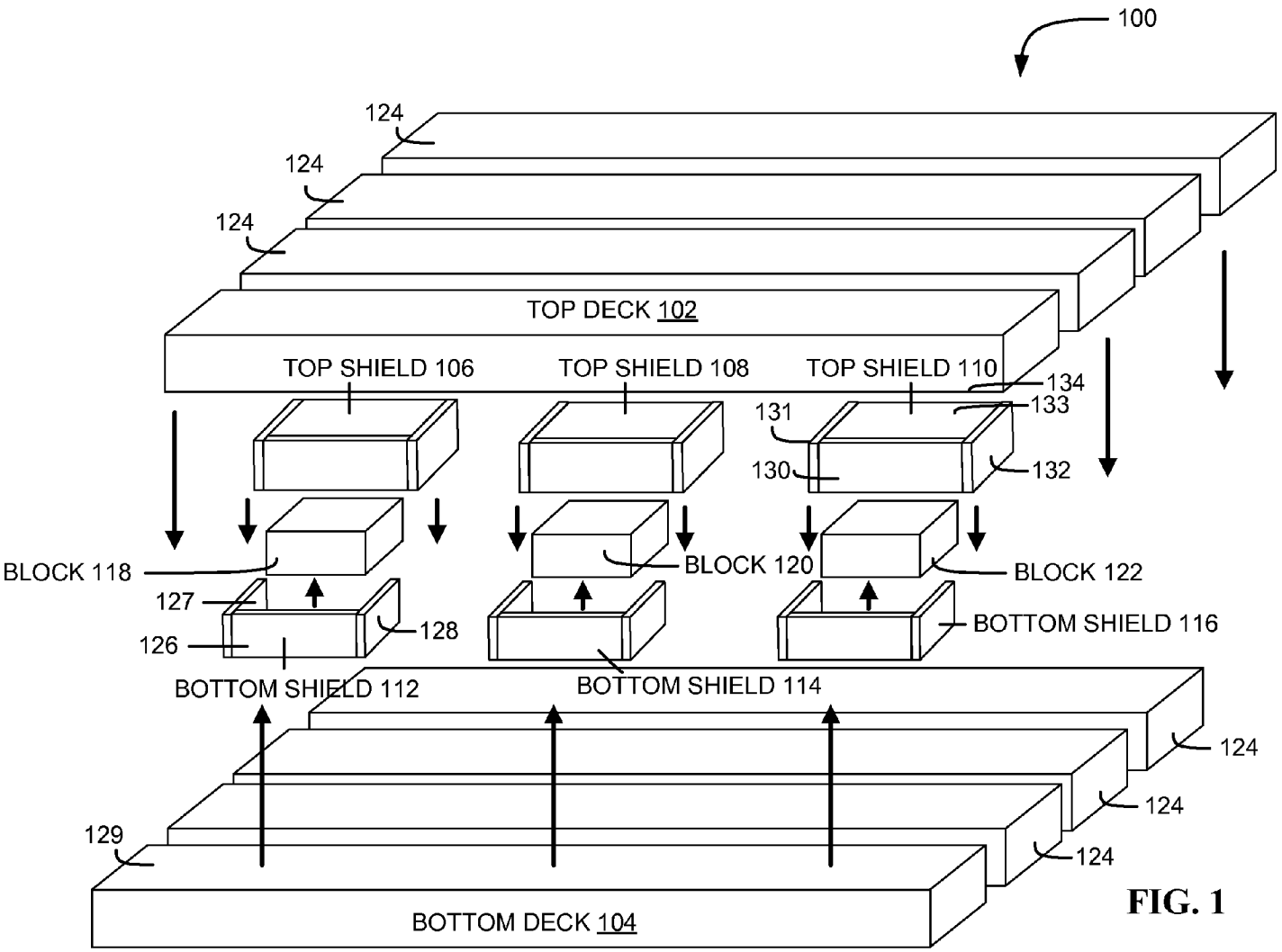
FIG. 1 depicts an exploded view of a block-style pallet positioned for attachment with a shield, consistent with embodiments of the present disclosure.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the present disclosure relate to pallets, more particular aspects relate to shields to protect pallet blocks and stringers. While the present disclosure is not necessarily limited to such applications, various aspects of the disclosure may be appreciated through a discussion of various examples using this context.

Various embodiments of the present disclosure are directed toward a shield configured to protect blocks and stringers of pallets from damage. Particular embodiments can have a pallet comprised of a first deck, a second deck, blocks or stringers between the decks, and protective shields covering or guarding the blocks and stringers. In certain embodiments, the shield can be a single piece and in other embodiments, the shield may be made up of two separate pieces. Particular pallet embodiments can have cushioned blocks or stringers (e.g., foam or rubber) used to dampen or absorb shock to the pallet when the pallet is being used (e.g., when products are being stacked on the pallet or when the pallet is being moved). Cushioned blocks can be more susceptible to damage than regular hard blocks (e.g., wood blocks). The shield may be connected to the pallet in a position that guards against possible hazardous objects, but still allows the cushioned block to use its dampening properties to soften or absorb some of the shock to the pallet. For example, pallets with cushioned blocks can be used so that high-end devices (e.g., servers that can cost in upwards of a million dollars) can be moved and shipped without being damaged. These devices can be extremely heavy (e.g., upwards of 1000 lbs) and it could be too difficult to pick up and turn the pallet and device. Tines on forklifts are then used to turn the palletized device by pushing on a cushioned block. As a result, the cushioned block can be damaged and a pallet with a damaged block may no longer have the same dampening properties and the device may be more susceptible to damage. Particular embodiments can have a cushioned block that is susceptible to coming into contact with the tines of a forklift. According to various embodiments, a shield may protect the cushioned block from the tines, allowing the cushioned block to dampen the shock and vibrations that the pallet may experience during movement and shipping.

According to various embodiments, a block or stringer between decks of a pallet can be a damping device. The damping device can be configured to counteract the compressing and extending of the pallet. In certain embodiments, when the first deck and the second deck are pressed together, the damping device can contract such that, the more the first deck and the second deck are pressed together, the greater the force the damping device uses to push the first deck and the second deck apart. Then, when the first deck and the second deck are pulled apart, the damping device can deform such that, the more the first deck and the second deck are separated, the greater the force the damping device uses to pull the first deck and the second deck back together. In particular embodiments, the damping device can expand so that the force increases as the damping device is stretched. In other embodiments, the damping device can be configured with an absorption mechanism that is outside the first and second deck and the absorption mechanism can contract so that the force increases as the first deck and the second deck are pulled apart.

Various embodiments can have the shield configured to protect the damping device from damage. In one embodiment, the first deck of the pallet is the top deck and the second deck is the bottom deck. The shield can have a first planar member that is adjacent to the top surface of the top deck or the bottom surface of the bottom deck. When the first planar member is adjacent to the top surface of the top deck, the shield can have a second planar member that is adjacent to an edge of the top deck so that the shield overlaps the top deck and the second planar member can extend at least to the top surface of the bottom deck. In this configuration, the shield can cover the damping device from potential hazards (e.g., the tines of a fork lift) and reside outside the pallet so the second planar member does not push against the top surface of the bottom deck when the top deck and the bottom deck are pressed together. As a result, the shield may not interfere with the dampening properties of the dampening device.

When the first planar member is adjacent to the bottom surface of the bottom deck, the second planar member can be adjacent to an edge of the bottom deck so that the shield overlaps the bottom deck and the second planar member can extend at least to the bottom surface of the top deck. Similar to the previous embodiment, this will allow the shield to cover the damping device and reside outside the pallet so the second planar member does not push against the bottom surface of the top deck when the top deck and the bottom deck are pressed together.

In another embodiment, the shield can be comprised of a top shield and a bottom shield. The top shield can have a first planar member that is adjacent to the top surface of the top deck and a second planar member that is adjacent to the edge of the top deck. The bottom shield can have a first planar member that is adjacent to the bottom surface of the bottom deck and a second planar member that extends at least to the second planar member of the top shield and overlaps the second planar member of the top shield. In this configuration, the shield can cover the damping device from potential hazards and the shields may not push against the decks of the pallets or one another when the top deck and the bottom deck are pressed together. In another embodiment, the second planar member of the bottom shield can be adjacent to the edge of the bottom deck and the second planar member of the top shield can overlap the second planar member of the bottom shield. In this configuration the shields can work similar to the previous configuration.

In still another embodiment, the top shield can have a first planar member that is adjacent to the bottom surface of the top deck and a second planar member that is adjacent to the block, stringer, or dampening device. The bottom shield can have a first planar member that is adjacent to the top surface of the bottom deck and a second planar member that extends at least to the second planar member of the top shield and overlaps the second planar member of the top shield. In this configuration, the shield can cover the damping device from potential hazards and the shields may not push against the decks of the pallets or one another when the top deck and the bottom deck are pressed together. In yet another embodiment, the second planar member of the bottom shield can be adjacent to the block, stringer, or dampening device and the second planar member of the top shield can overlap the second planar member of the bottom shield. In this configuration the shields can work similar to the previous configuration.

Turning now to the figures, FIG. 1 depicts an exploded view of a block-style pallet 100 positioned for attachment with a shield, consistent with embodiments of the present disclosure. The pallet 100 may be constructed from wood or another suitable material. According to various embodiments, the pallet 100 can include a top deck 102, a bottom deck 104, blocks 118, 120, 122, top shields 106, 108, 110, and bottom shields 112, 114, 116. The top and bottom decks can be constructed from two or more planks 124, as shown, or from a single sheet of material. In certain embodiments, blocks 112, 114, and 116 can be cushioned blocks (e.g., foam and rubber) and the top shields and bottom shields can be metal, molded plastic, wood, etc. Top shields 106, 108, and 110 can be attached to the top deck 102 and bottom shields 112, 114, and 116 can be attached to the bottom deck 104 using nails, screws, or another type of fastener. In various embodiments, one or more of the top shields 106-110 or the bottom shields 112-116 may be integrally formed, respectively, with a top or bottom deck 102, 104. The top shields and bottom shields can also be attached to the blocks using nails, screws, or another type of fastener.

The arrows in the exploded view of FIG. 1 are meant to depict the direction the different parts move to assemble the pallet 100. As shown, during assembly, the planks 124 of the top deck 102 move down and the planks 124 of the bottom deck 104 move up. In particular embodiments, the bottom shields 112, 114, and 116 are above the bottom deck 104. The bottom shield 112 can be comprised of a front planar member 126, side planar members 127, 128, and a bottom planar member (not visible in FIG. 1, but can be seen in FIG. 2 as bottom planar member 227) (bottom shields 114 and 116 can also be comprised of a front planar member, side planar members, and a bottom planar member; however, they are not numbered in FIG. 1). When the pallet 100 is assembled, the bottom shields can be attached to the blocks using nails, screws, or another type of fastener so that the top deck 102 is secured to the bottom deck 104. In addition, the bottom planar member of the bottom shield 112 can be adjacent to a top surface 129 of the bottom deck. The bottom shield 112 can also include the front planar member 126 and side planar members 127, 128 to partially or completely enclose a respective block 118.

In various embodiments, the top shields 106-110 can be comprised of a front planar member 130, side planar members 131, 132, and a top planar member 133. When the pallet 100 is assembled, the top shields can be attached to the blocks using nails, screws, or another type of fastener so that the top deck 102 is secured to the bottom deck 104. In addition, the top planar member 133 can be adjacent to a bottom surface 134 of the top deck. The top shield 110 can also include the front planar member 130 and side planar members 131, 132 to at least partially enclose block 122.

Figure 4:
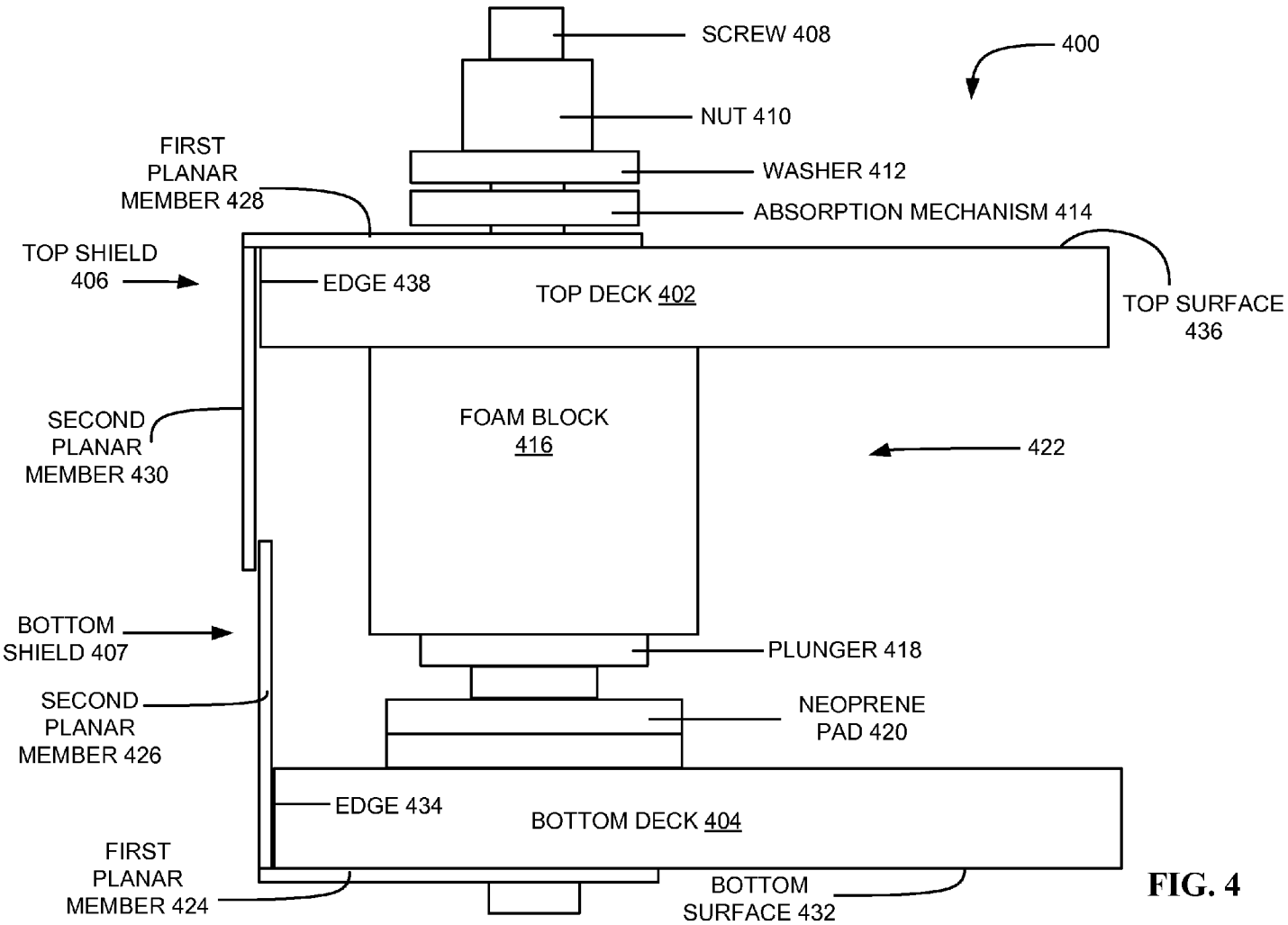
FIG. 4 depicts an example cross sectional view of a portion of a pallet with a dampening device, consistent with embodiments of the present disclosure.

A direction proceeding from a bottom deck to a top deck may be referred to herein as a "vertical" direction. A direction perpendicular to the vertical direction may be referred to herein as a "horizontal" direction. The vertical width of the top shields 106-110 and bottom shields 112-116 may each be less than the vertical widths of the blocks 118-122. In addition, the vertical width of the top shields 106-110 and bottom shields 112-116 may each be greater than fifty percent of the vertical widths of the blocks 118-122. Accordingly, each top shield may overlap vertically with a corresponding bottom shield as shown in FIG. 4. As one example, the vertical widths of blocks 118-122 may be 15 cm and the vertical widths of the top shields 106-110 and bottom shields 112-116 may each be 8 cm. Moreover, the top shields 106-110 and bottom shields 112-116 may be offset from in a horizontal direction so that the shields do not contact one another in an assembled position.

The example top shields 106, 108, 110 and bottom shields 112, 114, 116 generally have three or four planar members (e.g., 126, 127, 128, 130, 131, 132, and 133) that cover, partially or completely enclose, go around, overlap, and protect blocks 112, 114, and 116 from damage by accepting, absorbing and spreading out a force when a damage causing device (e.g., the tines of a forklift) hits the blocks. To provide the feature of spreading and absorbing forces, the three or four planar members of the top shields and bottom shields should be strong and therefore comprised of a suitable material such as metal or molded plastic and may be, for example, thick.

One example of a damage causing event that can occur to a pallet is when a device is heavy and there is little room to lift and rotate the palletized device. In theses instances, the tines of a forklift can be used to push on a block of a pallet at an angle that can slide and rotate the palletized device. This pushing can damage the integrity of the block such that further degradation occurs even if all future pallet uses are more proper. Another example of a damage causing event is when a pallet is being approached and the tines are either not inline with the openings of the pallet or the pallet is not being addressed square on. Rather than slide into the appropriate openings and proceed parallel to the stringers or blocks, the points of the tines can hit and gouge, splinter, or dent the blocks. To mitigate the damage that can be caused by the tines, the top shields 106, 108, 110 can vertically overlap bottom shields 112, 114, 116 such that the blocks 118, 120, and 122 are not exposed to the tines and the top shields and bottom shields can take the brunt of the force.

Figure 2:
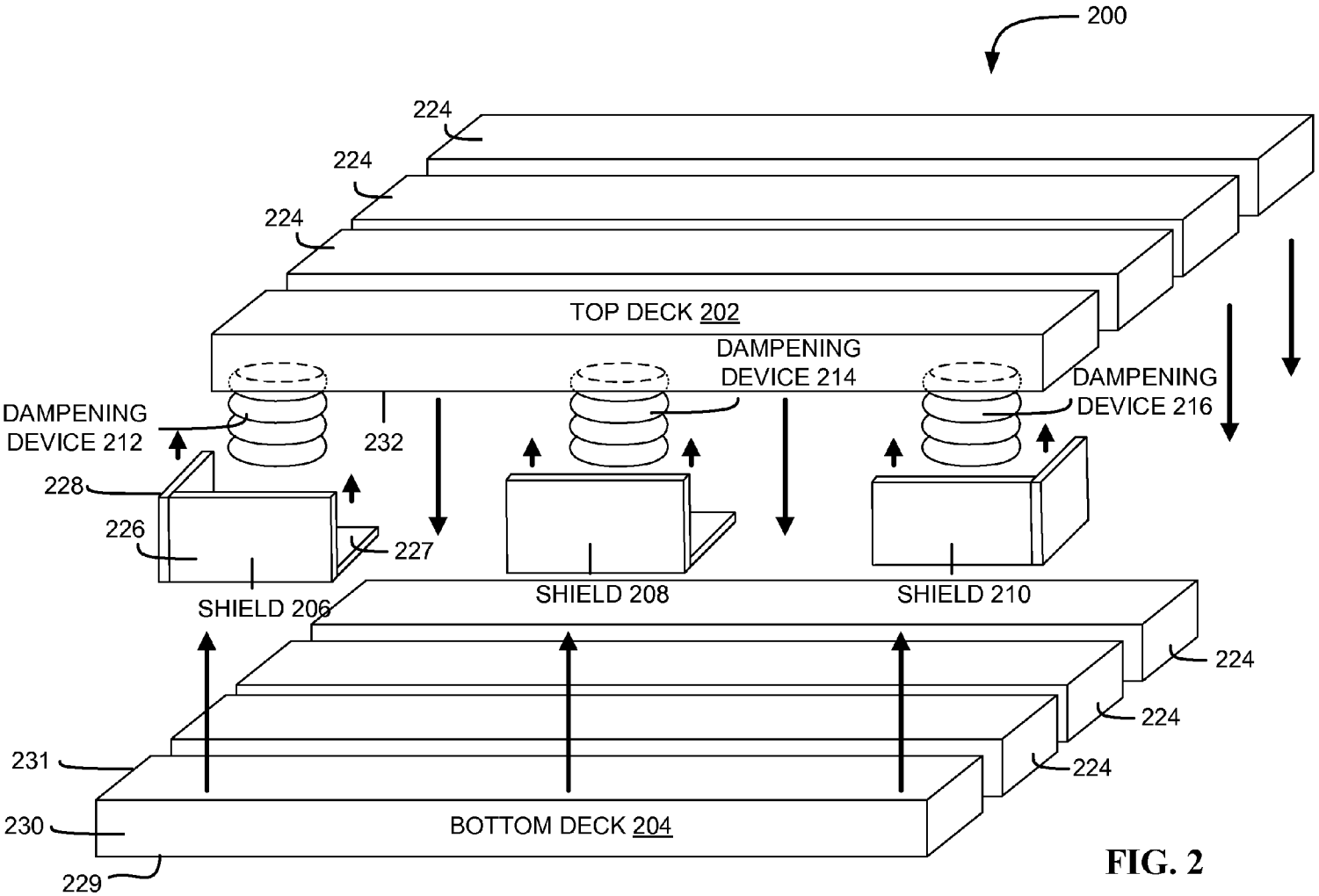
FIG. 2 depicts an exploded view of a block-style pallet with a dampening device and positioned for attachment with a shield, consistent with embodiments of the present disclosure.

FIG. 2 depicts an exploded view of a block-style pallet 200 with a dampening device and positioned for attachment with a shield, consistent with embodiments of the present disclosure. The pallet 200 may be constructed from wood or another suitable material. According to various embodiments, the pallet 200 can include a top deck 202, a bottom deck 204, dampening devices 212, 214, 216, and shields 206, 208, 210. The top and bottom decks can be constructed from two or more planks 224, as shown, or from a single sheet of material. The shields 206, 208, and 210 can be attached to the bottom deck 204 using nails, screws, or another type of fastener. In various embodiments, one or more of the shields 206-210 may be integrally formed, respectively, with the bottom deck 204. In addition, the shields can be metal, molded plastic, wood, etc.

The arrows in the exploded view of FIG. 2 are meant to depict the direction the different parts move to assemble the pallet 200. As shown, during assembly, the planks 224 of the top deck 202 move down and the planks 224 of the bottom deck 204 move up. In particular embodiments, the shield 206 can have a front planar member 226, a bottom planar member 227, and a side planar member 228 (shield 208 can also be comprised of a front planar member and a bottom planar member and shield 210 can be comprised of a front planar member, a side planar member, and a bottom planar member; however, they are not number in FIG. 2). When the pallet 200 is assembled, the bottom planar member 227 can be adjacent to a bottom surface 229 of the bottom deck. In addition, the shield 206 can include the front planar member 226 that is adjacent to an edge 230 of the bottom deck 204 and the side planar member 228 that is adjacent to another edge 231 of the bottom deck 204. The front planar member 226 and the side planar member 228 can extend at least to a bottom edge 232 of the top deck to partially or completely cover, overlap, and protect dampening device 212 from damage by accepting, absorbing and spreading out a force when a damage-causing device (e.g., the tines of a forklift) would otherwise hit the blocks, similar to the top shields and bottom shields from FIG. 1. Furthermore, because the shields are adjacent to and border and the edges of the bottom deck 204 (essentially wrapping around the corner of the bottom deck 204), they may be offset horizontally from the top deck 202. As a result, when the top deck 202 and bottom deck are pressed together, the front planar member 226 and the side planar member 228 may not press against the top deck. As a result, the shields may not interfere with the dampening and absorbing properties of the dampening devices.

Figure 3:
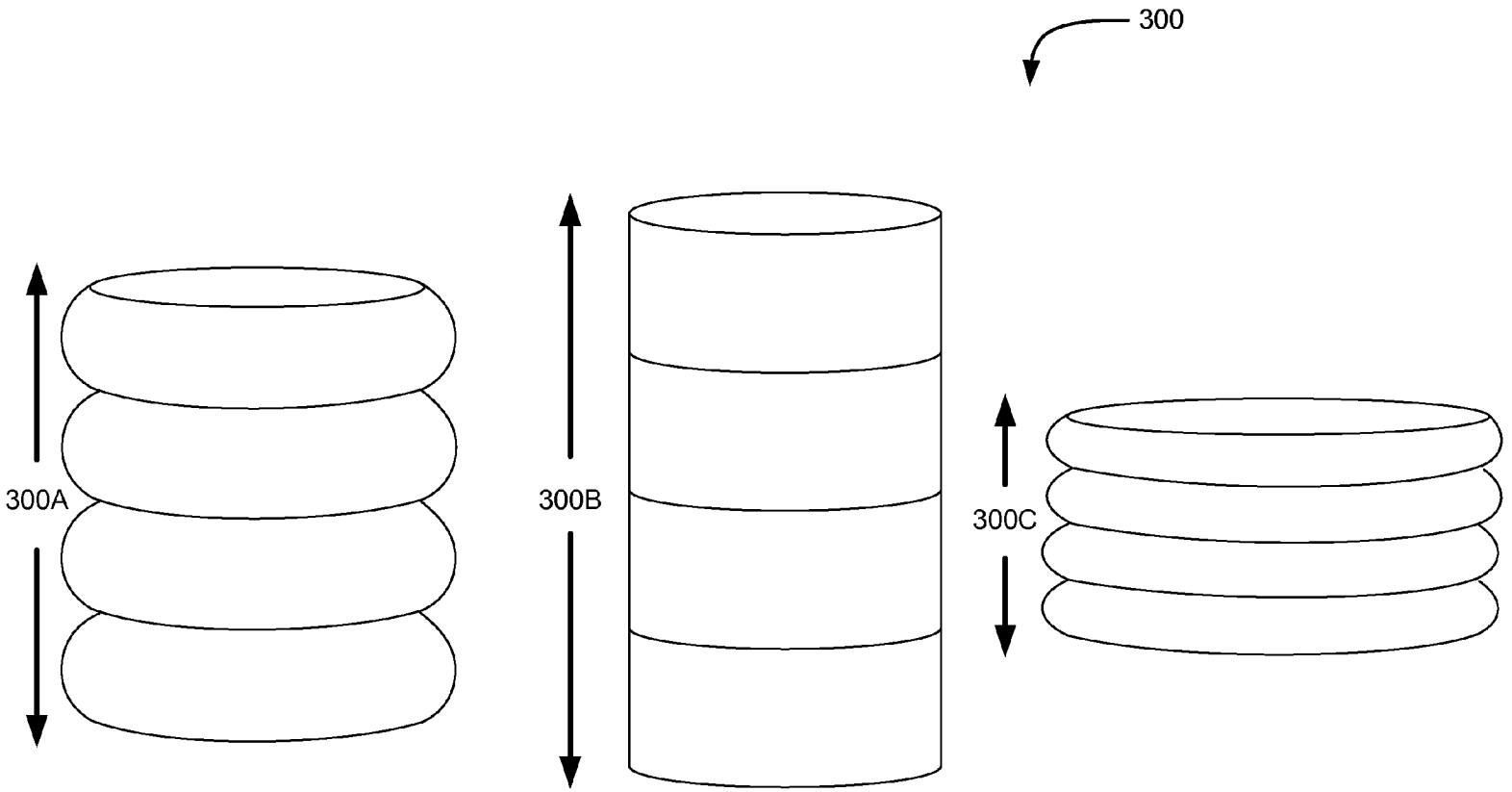
FIG. 3 depicts an example of a dampening device, consistent with embodiments of the present disclosure.

FIG. 3 depicts an example of a dampening device 300, consistent with embodiments of the present disclosure. FIG.

3 illustrates the change in the vertical dimension of a dampening device, such as the various dampening devices discussed herein may undergo during operation. The damping device 300 can be configured to counteract the compressing and extending of the pallet (e.g., pallet 200). Under no load (e.g., when a pallet is not in use and does not have a device on top of it) the dampening device may have a vertical dimension 300A. In particular embodiments, the damping device can be configured to stretch when the first deck and the second deck are pulled apart and the dampening device may have a vertical dimension 300B304. In this configuration, the force exerted by the dampening device 300 may increase as the decks are extended apart. In addition, in certain embodiments, when the first deck and the second deck are pressed together, the damping device may contract and have a vertical dimension 300C. In this configuration, the force exerted by the dampening device may increase as the decks are compressed together. However, this is only one embodiment and there may be other configurations of the dampening device. For instance, the damping device can be configured with an absorption mechanism that would lie above a top deck, below a bottom deck, or both and the absorption mechanism could be configured to contract so that the force it exerts increases as the top deck and the bottom deck are pulled apart.

FIG. 4 depicts an example cross sectional view of a portion of a pallet 400 with a dampening device 422, consistent with embodiments of the present disclosure. The pallet can include a bottom shield 407 and a top shield 406. The dampening device 422 can include a screw 408, a nut 410, a washer 412, absorption mechanism 414, neoprene pad 420, a foam block 416, and a plunger 418. The screw 408, nut 410, and washer 412 can be for connection purposes and can be replaced by another type of fastener. Absorption mechanism 414, foam block 416, and neoprene pad 420 can be used to provide shock absorption and vibration isolation for large machine tools and can achieve a low resonant frequency of around 13 Hz, which can effectively isolate/protect products in the 25 to 30 Hz range. The dampening device 422 can change its stiffness as the load on the pallet is increased or decreased. The plunger 418 can vary the stiffness of the pallet. As the load on the pallet increases, the plunger 418 can become more embedded into the neoprene pad 420, increasing the stiffness of the dampening device. As a result, in various embodiments, increasing the mass on the pallet can cause the dampening device 422 to become stiffer such that the natural frequency remains approximately the same for different loads.

In this example, the bottom shield 407 has a first planar member 424 that is adjacent to a bottom surface 432 of the bottom deck 404 and a second planar member 426 that is adjacent to an edge 434 of the bottom deck. The top shield 406 has a first planar member 428 that is adjacent to a top surface 436 of the top deck 402. The top shield 406 also has a second planar member 430 that is adjacent to an edge 438 of the top deck 402. The second planar member 430 of the top shield extends at least to the second planar member 426 of the bottom shield. As shown in FIG. 4, the second planar member 430 of the top shield and the second planar member 426 of the bottom shield may extend vertically past one another in various embodiments. In addition, as shown in FIG. 4, the second planar members 426 and 430 may horizontally offset from one another to permit the members 426 and 430 to extend past one another vertically, according to various embodiments. The top shield and bottom shield may be configured to protect the dampening device similar to the way the top shields 106, 108, 110 and bottom shields 112, 114, 116 (from FIG. 1) partially or completely cover, partially or completely enclose, go around, overlap, and protect blocks 118, 120, and 122 (from FIG. 1).

Figure 5:
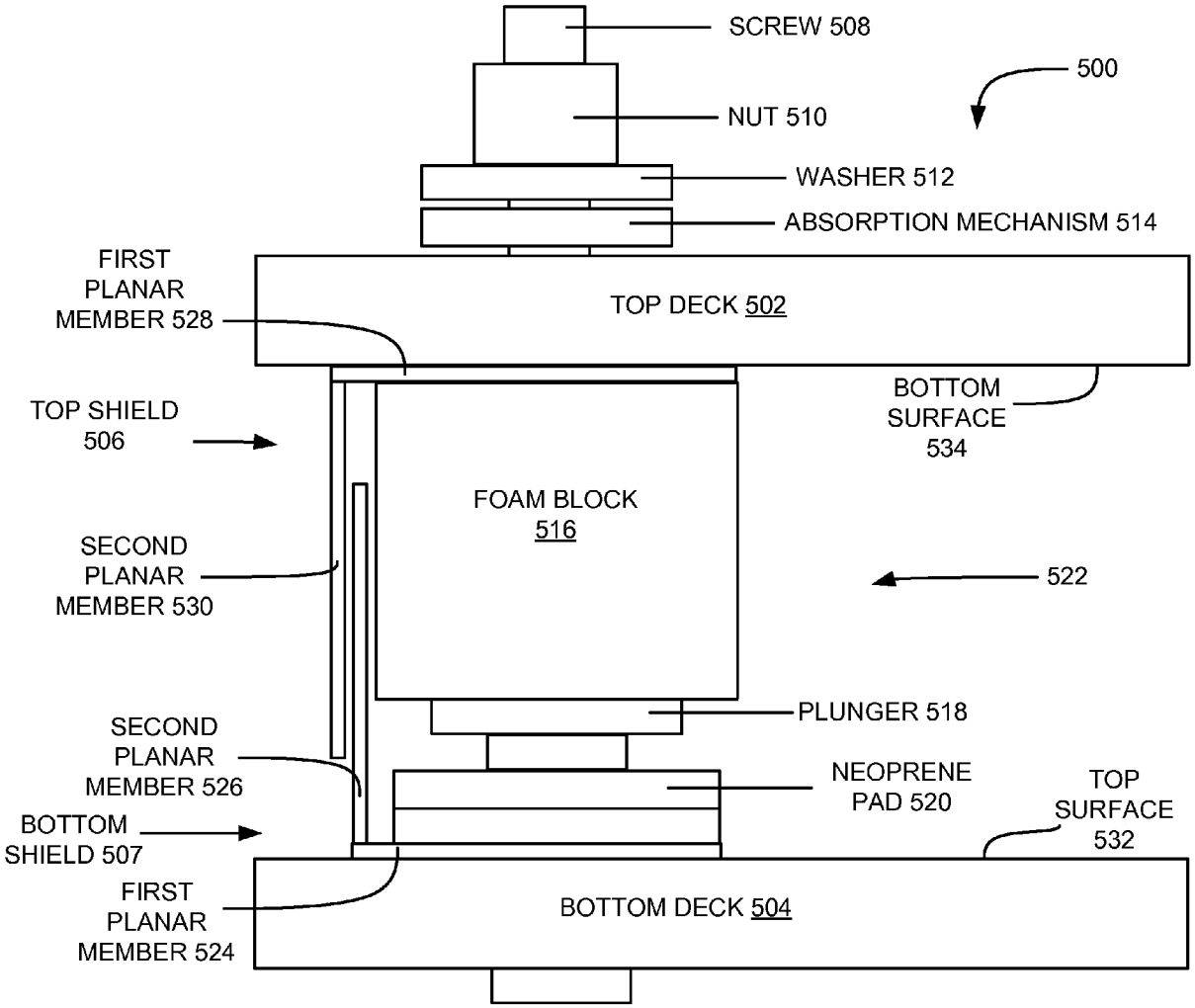
FIG. 5 depicts another example cross sectional view of a portion of a pallet with a dampening device, consistent with embodiments of the present disclosure.

FIG. 5 depicts another example cross sectional view of a portion of a pallet 500 with a dampening device 522, consistent with embodiments of the present disclosure. The pallet 500 can include a bottom shield 507 and a top shield 506. The dampening device can be configured to operate similar to the dampening device 422 (from FIG. 4). In this example, the bottom shield 507 has a first planar member 524 that is adjacent to a top surface 532 of the bottom deck 504 and a second planar member 526 that is adjacent to a foam block 516. The top shield 506 has a first planar member 528 that is adjacent to a bottom surface 534 of the top deck 502 and a second planar member 530 that extends at least to the second planar member 526 of the bottom shield 507. As shown in FIG. 5, the second planar member 530 of the top shield and the second planar member 526 of the bottom shield may extend vertically past one another in various embodiments. In addition, as shown in FIG. 5, the second planar members 526 and 530 may horizontally offset from one another to permit the members 526 and 530 to extend past one another vertically, according to various embodiments. The top shield and bottom shield may be configured to protect the dampening device similar to the way the top shields 106, 108, 110 and bottom shields 112, 114, 116 (from FIG. 1) cover, partially or completely enclose, go around, overlap, and protect blocks 118, 120, and 122 (from FIG. 1).

Figure 6:
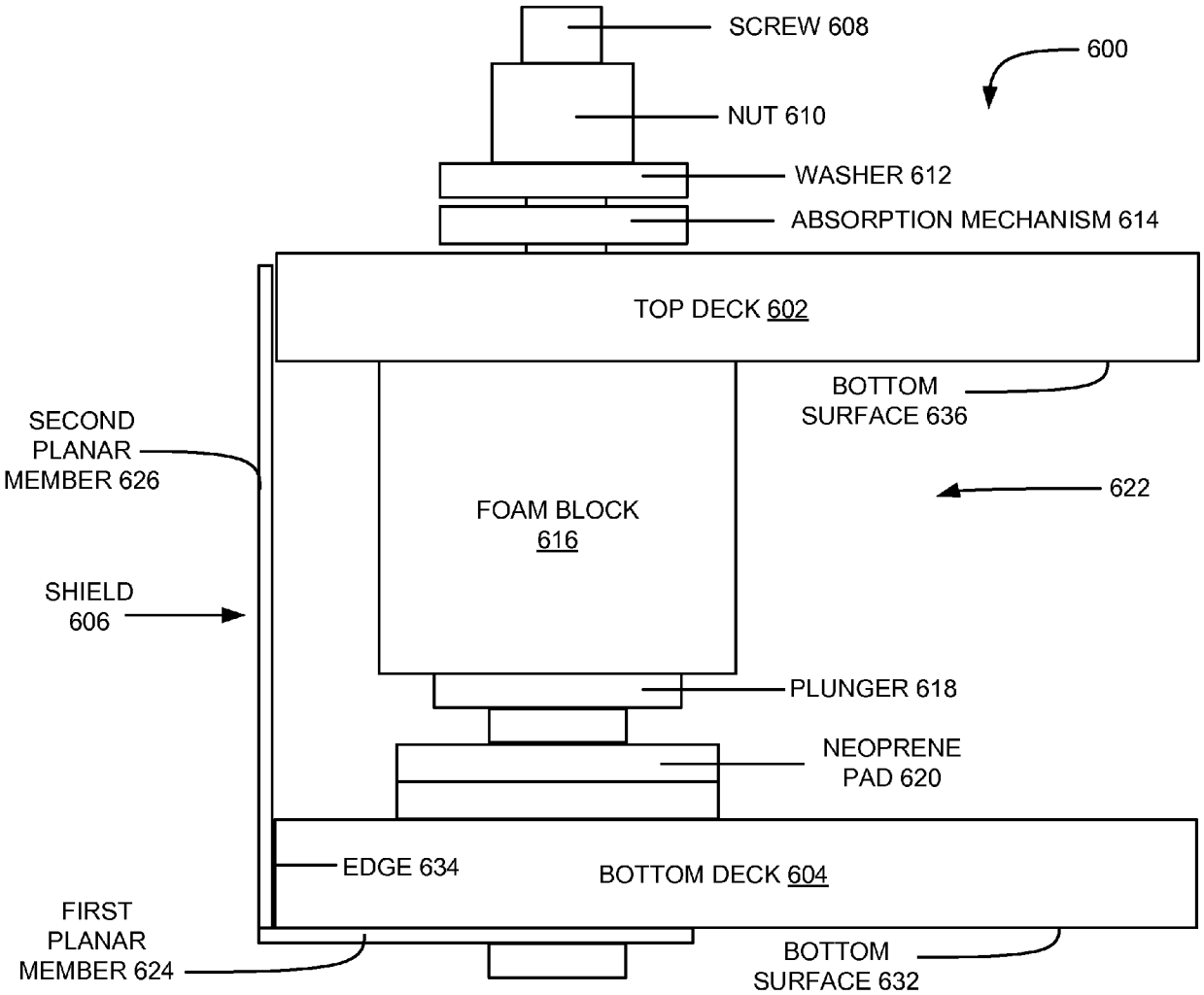
FIG. 6 depicts another example cross sectional view of a portion of a pallet with a dampening device, consistent with embodiments of the present disclosure.

FIG. 6 depicts another example cross sectional view of a portion of a pallet 600 with a dampening device 622, consistent with embodiments of the present disclosure. The pallet 600 can include a shield 606. The dampening device can be configured to operate similar to the dampening device 422 (from FIG. 4). In this example, the shield 606 has a first planar member 624 that is adjacent to a bottom surface 632 of a bottom deck 604 and a second planar member 626 that is adjacent to an edge 634 of the bottom deck and extends at least to a bottom surface 636 of a top deck 602. As shown in FIG. 6, the second planar member 626 of the shield may extend vertically past the bottom surface 636 of the top deck 602 in various embodiments. In addition, as shown in FIG. 6, the second planar members 626 may be horizontally offset from the top deck 602 to permit the second planar member 626 to extend past the bottom surface 636 of the top deck vertically, according to various embodiments. The shield 606 may be configured to protect the dampening device similar to the way the top shields 206, 208, and 210 (from FIG. 2) partially or completely cover, partially or completely enclose, go around, overlap, and protect dampening devices 212, 214, and 216 (from FIG. 2).

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. A pallet comprising:

a first deck having a first interior surface, an exterior surface and an edge;

a second deck having a second interior surface facing the first interior surface of the first deck;

a dampening device between the first interior surface of the first deck and the second interior surface of the second deck configured to contract to counteract a compression force when the first deck and the second deck are pressed together and further configured to deform to counteract an expansive force when the first deck and the second deck are pulled apart;

a first shield including:

a first planar member adjacent to the exterior surface of the first deck opposite the dampening device, and a second planar member extending from the first planar member to the second interior surface of the second deck and adjacent to the edge of the first deck; and a second shield including:

a third planar member that is offset from the second planar member in a horizontal direction, the horizontal direction substantially parallel to the first and second interior surfaces.

2. The pallet of claim 1, the first shield further comprising:

a third planar member extending from the first planar member to the second interior surface of the second deck and adjacent to a second edge of the first deck.

3. The pallet of claim 1, wherein the first shield is made of metal.

4. The pallet of claim 1, wherein the first shield is made of molded plastic.

5. The pallet of claim 1, wherein the dampening device is configured to stretch to counteract the expansive force.

6. The pallet of claim 1, wherein the dampening device has an absorption mechanism configured to contract to counteract the expansive force.

7. A pallet comprising:

a first deck having a first interior surface, a first exterior surface, and first edge;

a second deck having second interior surface, a second exterior surface, and a second edge;

a dampening device between the first interior surface of the first deck and the second interior surface of the second deck;

a first shield including:

a first planar member adjacent to the first exterior surface of the first deck and opposite the dampening device, and a second planar member extending from the first planar member towards the second interior surface of the second deck and adjacent to the first edge of the first deck; and a second shield including:

a third planar member adjacent to the second exterior surface of the second deck and opposite the dampening device, and a fourth planar member extending from the third planar member towards the first interior surface of the first deck to at least the second planar member of the first shield, wherein the second planar member of the first shield and the fourth planar member of the second shield are offset from one another in a horizontal direction, the horizontal direction substantially parallel to the first and second interior surfaces.

8. The pallet of claim 7, the first shield further comprising:

a fifth planar member extending from the first planar member towards the second interior surface of the second deck and adjacent to a third edge of the first deck; and the second shield further comprising:

a sixth planar member extending from the third planar member towards the first interior surface of the first deck to at least the fifth planar member of the first shield.

9. The pallet of claim 7, wherein the first shield and the second shield are made of metal.

10. The pallet of claim 7, wherein the first shield and the second shield are made of molded plastic.

11. The pallet of claim 7, wherein the dampening device is a block.

12. The pallet of claim 7, wherein the dampening device is configured to contract to counteract a compression force when the first deck and the second deck are pressed together and further configured to deform to counteract an expansive force when the first deck and the second deck are pulled apart.

13. A pallet comprising:

a first deck having a first interior surface;

a second deck having a second interior surface facing the first interior surface;

a dampening device between the first deck and the second deck;

a first shield including:

a first planar member between the first interior surface of the first deck and the dampening device, and a second planar member extending from the first planar member towards the second interior surface of the second deck; and a second shield including:

a third planar member between the second interior surface of the second deck and the dampening device, and a fourth planar member extending from the first planar member towards the first interior surface of the first deck to at least the second planar member of the first shield, wherein the second planar member of the first shield and the fourth planar member of the second shield are offset from one another in a horizontal direction, the horizontal direction substantially parallel to the first and second interior surfaces.

14. The pallet of claim 13, the first shield further comprising:

a fifth planar member extending from the first planar member towards the second interior surface of the second deck, and a sixth planar member extending from the first planar member towards the second interior surface of the second deck; and the second shield further comprising:

a seventh planar member extending from the first planar member towards the first interior surface of the first deck to at least the fifth planar member of the first shield, and an eighth planar member extending from the first planar member towards the first interior surface of the first deck to at least the sixth planar member of the first shield.

15. The pallet of claim 13, wherein the first shield and the second shield are made of metal.

16. The pallet of claim 13, wherein the first shield and the second shield are made of molded plastic.

17. The pallet of claim 13, wherein the dampening device is a block.

18. The pallet of claim 13, wherein the damping device is configured to contract to counteract a compression force when the first deck and the second deck are pressed together and further configured to deform to counteract an expansive force when the first deck and the second deck are pulled apart.

* * * * *